US007682009B1

(12) United States Patent
Sliwa, Jr. et al.

(10) Patent No.: US 7,682,009 B1
(45) Date of Patent: Mar. 23, 2010

(54) COOLING, CONDENSATION AND FREEZING OF ATMOSPHERIC WATER OR OF A MICROFLUIDIC WORKING-MATERIAL IN OR ON MICROFLUIDIC DEVICES

(76) Inventors: John W. Sliwa, Jr., 897 Madonna Way, Los Altos, CA (US) 94024; Carol A. Tosaya, 897 Madonna Way, Los Altos, CA (US) 94024

( * ) Notice: Subject to any disclaimer, the term of this patent is extended or adjusted under 35 U.S.C. 154(b) by 722 days.

(21) Appl. No.: 11/141,350

(22) Filed: May 31, 2005

Related U.S. Application Data

(60) Provisional application No. 60/576,047, filed on Jun. 1, 2004.

(51) Int. Cl.
*B41J 2/17* (2006.01)

(52) U.S. Cl. ..... 347/95

(58) Field of Classification Search ..... 347/7, 347/21, 23, 95, 96, 97; 210/175, 179, 180, 210/187, 767, 770; 399/250, 254
See application file for complete search history.

(56) References Cited

U.S. PATENT DOCUMENTS

| | | | | |
|---|---|---|---|---|
| 5,532,720 | A * | 7/1996 | Krueger et al. | 347/7 |
| 5,628,914 | A * | 5/1997 | Prasil | 210/770 |
| 6,101,356 | A * | 8/2000 | Kim et al. | 399/250 |
| 7,018,012 | B2 * | 3/2006 | Edelen et al. | 347/40 |

* cited by examiner

*Primary Examiner*—Anh T. N. Vo

(57) ABSTRACT

Condensation of water from a gas, such as from atmospheric air or other nearby ambient gas, is provided for use in a variety of jetting devices, such as inkjet and lab-on-a-chip applications. Further embodiments involve the use of frozen liquids, not limited to frozen condensed water, and microcooling of fluidic components or working materials for improved process control and reliability.

10 Claims, 10 Drawing Sheets

COOLING, CONDENSATION AND FREEZING OF ATMOSPHERIC WATER OR OF A MICROFLUIDIC WORKING-MATERIAL IN OR ON MICROFLUIDIC DEVICES

CROSS-REFERENCE TO RELATED APPLICATION

The present application claims priority from provisional application Ser. No. 60/576,047, filed Jun. 1, 2004.

BACKGROUND OF THE INVENTION

There is an ongoing application-explosion involving the manipulation and management of microscopic quantities of fluids for useful purposes. No application serves as a better example than the numerous permutations of inkjet-printers for commercial and personal printing applications that employ inks or marking materials. A multitude of methods for creating droplets and transferring them to substrates such as paper in desired patterns are known and many others are under development. The known methods include thermal-jetting drop-on-demand, piezo-jetting drop-on-demand, and pressurized continuous inkjets with electrical droplet steering. New methods under development and seen in the patent literature include ballistic aerosol printing and ballistic aerosol printing with gas flow droplet-deflection. There are many more not mentioned.

For the purposes of the invention herein, we define a "microfluidic device" as any device or component that utilizes, implements or supports the storage, management, arrangement, manipulation, analysis, processing or distribution of microscopic quantities of at least one working material. Thus, this clearly includes any droplet or particulate emitter used for any purpose as well as substrates or "labs-on-a-chip" upon or within which microfluidic quantities of material are stored, arrayed, combined, compared, analyzed, processed or otherwise manipulated. Examples would include all inkjets and combinatorial bioarrays made using "inks" comprising biological fluids as well as fluidic-incorporating "labs-on-a-chip" for clinical testing or environmental chemical sensing. By "fluid" we mean any flowable (or diffusible) material, mixture, suspension, solid, emulsion, solution, vapor, gas, liquid, slurry, fluidized media such as suspended cellular material, gel, cream, wax, oil, hydrocarbon, paste or solution. In short, we define a fluid as anything that can be moved or moves along at least one path, whether by net mass-transport, liquid flow, gas flow or even atomic or molecular flow as moving diffusing concentration-gradients. Such flow may be over macroscopic or microscopic distances or across a permeable or other membrane in the device.

Despite all of the investment in microfluidic devices, there are still some fundamental issues and challenges that have not been overcome to anyone's satisfaction. Solutions to these issues would provide further reduced costs, further reliability improvements, further inkjet image-quality improvements and better performing biochips. Some of these unsolved issues addressable by the invention herein are as follows:

Ink or Other Media Fouling and Clogging of Printheads and Nearby Printer Components.

Tiny nozzles and orifices tend to clog if they dry out or if they are contaminated during nozzle self-servicing steps involving wipers or scrapers. The trends toward jetted pigment-based inks and biological fluids are only making matters worse.

Ink, Media and Debris-Contamination and Wetting of the Printhead Orifice Face.

If the face of the printhead becomes fouled, then the orifice ink wets out onto the surface and causes misfires and unwanted deflection of droplets.

Shutdown, Startup and Priming of Printheads.

As printheads incorporate more and more fine orifices and channels, lumens, and conduits, the opportunity for the printhead to incorporate (e.g., grow) bubbles or other blockages during long standby periods increases. In particular, outgassing of ink and ingress of atmospheric gas can cause blocking bubbles in fine channels. Even inks with water-retention features such as glycol or hydrophilic constituents can eventually dry out or at least uncontrollably thicken at the ambient interface.

Use of Ink Dryer Modules.

There is a lot of developmental activity in the area of methods to dry ink quickly so that printed paper, for example, can be stacked soon after printing without smudging. Such suggested techniques involve everything from microwave drying to blown gases and infrared radiation. As one can easily discern, uncontrolled and unintended heating or convective drying of the printheads and their orifices could greatly worsen many of the above listed challenges.

Cartridge Life and Reliability Issues.

The management of dissolved gases in inks is becoming a major issue both for onaxis and off-axis ink tank strategies. Such air incorporation in an uncontrolled manner can lead to bubbles and unpredictable emission-bubble formation. It can also cause unpredictable cavitation in piezo-fired printheads and misfiring of thermal-bubblejets.

Customers have also complained loudly about perceived cartridge lifetime issues and perceived wasted-ink issues. The invention herein also offers a new method of ink provision that can avoid some of these difficulties, perceived or otherwise.

We emphasize the inkjet printer applications by way of example, but the reader will realize that the invention is equally applicable to microfluidic-based labs-on-a-chip wherein microparticulates, liquids and gases are processed and one has similar issues of shelf-life, clogging, material storage, and useful-life.

By inkjet printing we include all droplet or particulate microemission applications, whether continuous or drop-on-demand, regardless of the marking material involved. The marking material could be ink or could be microdroplets of biofluids being placed on or in a combinatorial bioarray, for example. By lab-on-a-chip we include any microfluidic component having miniature or microscopic conduits, reservoirs, valves or manifolds. This would include, for example, blood analysis labs-on-a-chip, urine analysis labs-on-a-chip, DNA analysis labs-on-a-chip, and chemical sensor arrays on-a-chip.

Thus, the present invention should be seen as offering generic improvements to the field of microfluidics in general, with microfluidics being defined as the manipulation, storage and/or processing of minute quantities of materials, as stated earlier.

The appendix contains a set of reference patents useful for understanding the applications of the invention herein. These patent references in no way lead to any embodiment of the invention but they do help the reader appreciate the seriousness of some of the challenges that we wish to solve with our inventive embodiments, and they demonstrate attempts at solving some of these issue to date.

SUMMARY OF THE INVENTION

The first category of embodiments involves condensation of liquid from a gas, such as from atmospheric air or other nearby ambient to include:

A. The use of condensed water in liquid or vapor form as an ink-constituent, diluent or as a working fluid in a lab-on-a-chip.

B. The use of condensed water in vapor-form to maintain a desired humidity in a droplet storage, meniscus, or droplet flightpath region, or in the region of a biochip fluid.

C. The use of condensed water in liquid or vapor form in support of flushing, priming or cleaning of microscopic pathways or conduits including nearby dirtied orifice regions.

D. The use of condensed water in liquid or vapor form to treat a patterned or unpatterned substrate for improved image quality or archivability, including use to process deposited or depositing inks.

E. The use of condensed water in liquid or vapor form for hydraulic, pneumatic or steam actuation of a MEMs device such as a microvalve.

The second category of embodiments involves the use of frozen liquids, not limited to frozen condensed water, to include:

F. The use of freezing, whether or not condensed water is also frozen, of printheads, ink volumes, reagents or biological materials to enable extended dormancy and quick re-actuation. In this invention, we define freezing to include either or both of crystalline freezing or amorphous or vitreous freezing, also known as vitrification. These are widely known phenomena, which differ mainly in the crystal structure of the "ice".

G. The use of freezing, whether or not condensed water is also frozen, to create structurally useful ice plugs or films, such as for providing an easily removed surface-protective coating, for plugging flow of an adjacent liquid, solid or gas, or for protective temporary plugging of an orifice.

And the third category involves microcooling of fluidic components or working materials for improved process control and reliability to include:

H. The use of localized cooling in order to render a temperature dependent phenomenon reproducible, such as an ink viscosity or a dissolved concentration of a gas in an emitted or fluidically-processed liquid. The phenomenon may also be controllably manipulated by the cooling.

In accordance with the invention, an apparatus for the useful manipulation of at least a first material is provided. The apparatus utilizes a condensate of a second material that is used in a physical form in support of the manipulation of the first material. The apparatus further comprises:

a manipulation means including at least one means used to manipulate, transport, emit, print, pattern, dispense, distribute, analyze, store, preserve, alter, react, culture or grow at least the first material;

a coupled condensation, solidification or freezing means capable of providing to or in support of the manipulation means a condensed, solidified or frozen phase of at least the second material;

the condensed, solidified or frozen phase of at least the second material being extracted or drawn from a gaseous, vaporous, humidity-containing or moisture-containing ambient; and the condensed, solidified or frozen phase of at least the second material being utilized in a physical form as a source or enabler in a device for at least one of: a) a constituent to be mixed, dissolved, entrained or otherwise combined with the first material, b) an agent for cleaning, flushing or surface-preparation of the device, c) a propellant for the device, d) a diluent for the device, e) a reagent for the device, f) a pressurization material for the device, g) a transport medium for the first material in the device, h) controlled constriction or shutoff of a related flow passage, orifice or microfluidic feature of the device, i) preservation of the first material in or on the device, j) cultivation or growth of the first material in or on the device, k) activation of the first material, and l) analysis or characterization of the first material.

Further in accordance with the present invention, a water-utilizing energy-source comprises:

an energy-source operative to produce electrical energy;

an at least temporary need for water to a) enable the startup, operative cycle or shutdown of the energy source or b) to serve as an operative constituent of the energy source; and condensation means coupled to the energy source capable of delivering water in a physical state to the energy source;

the energy source utilizing the condensed water in some state to perform its function.

Still further in accordance with the present invention, a method is provided for varying a cross-sectional dimension of a conduit or orifice used for transporting a flow of or communicating a pressure of a material. The method comprises:

providing a conduit, channel, lumen or orifice having a cross-sectional area, wherein the conduit, channel, lumen or orifice is capable of carrying or communicating a flow, a pressure or a diffused concentration of the material in a physical state;

providing a cooling means capable of freezing or solidifying in any manner the material to an interior surface of the conduit or orifice; and operating the cooler to bring about such freezing or solidification in order to cause a desired change in the cross-sectional area of said conduit, channel, lumen or orifice.

BRIEF DESCRIPTION OF THE DRAWINGS

The following figures will be utilized to explain the various embodiments of the invention, all of which involve cooling and microfluidic devices.

DETAILED DESCRIPTION OF THE INVENTION

Figure 1A:
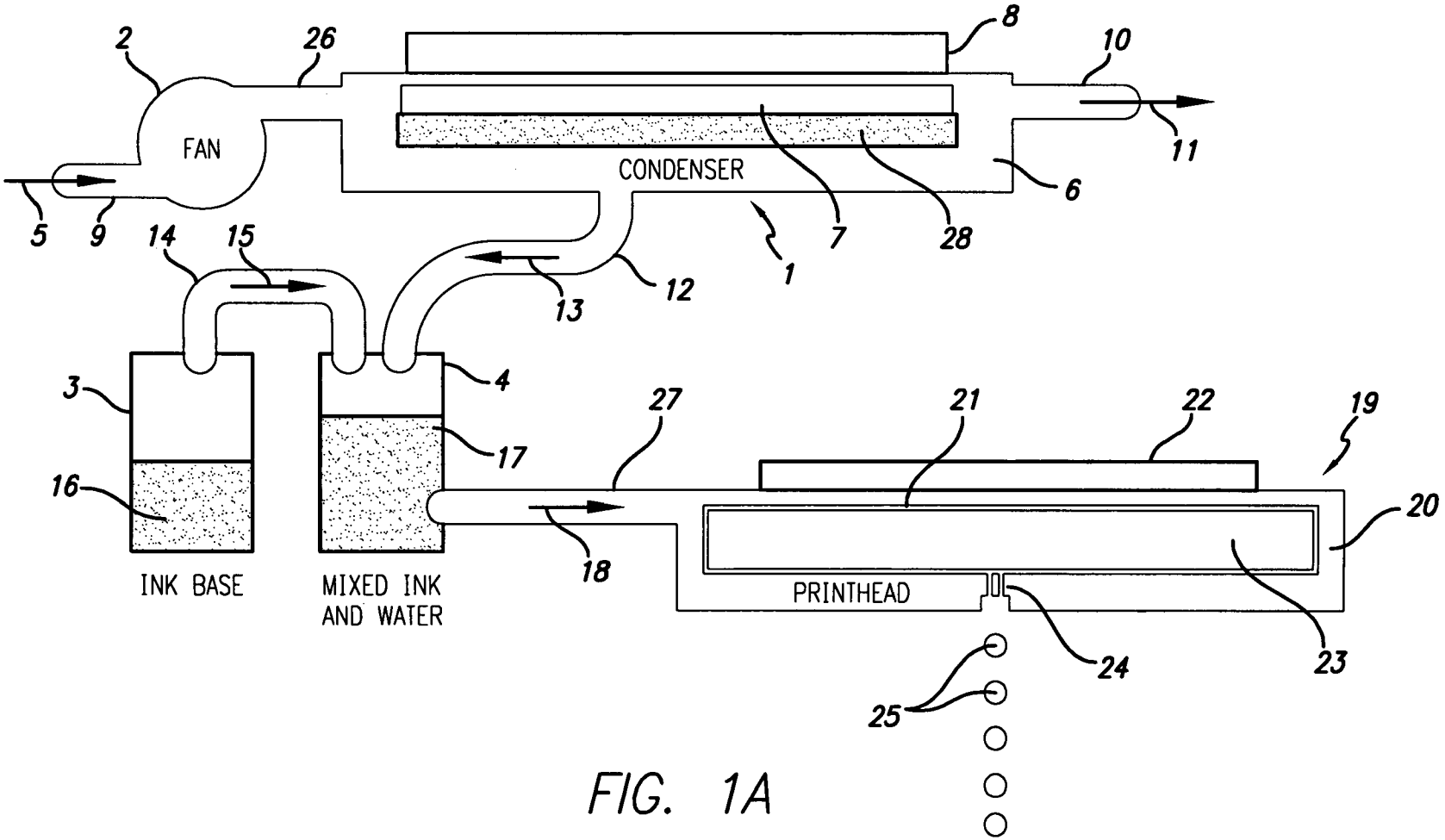
FIGS. 1A and 1B schematically depict embodiments wherein condensed water is employed as a working fluid in an inkjet and biochip, respectively.

Moving now to FIG. 1A, we see a water-condensation unit 1 whose condensed water is routed, ultimately, to a microfluidic printhead 19. A fan 2 is shown drawing inwards ambient air in the form of flow 5 through conduit 9 and passing it into output conduit 26. Conduit 26 feeds into condenser 1. The structure of water condenser 1 includes a body 6 having a chamber 7. A cooling or chilling means 8 is thermally coupled to the chamber 7. The cooling means 8 could, for example, be a semiconductor-type electronic junction solid-state cooling chip (e.g., a thermojunction), which is preferred, or could be a known expansion nozzle refrigerator subsystem. Condenser 1 is depicted having a gaseous output conduit 10 with an outflow 11. In essence, ambient air 5 is drawn into the condenser 1 and has liquid water 28 condensed out of it. The drier air is then exhausted out conduit 10 as flow 11. It will be noted that condensate water 28 preferably sits in chamber or reservoir 7. Those familiar with condensation will know that the condensate is quite pure. On the bottom of condenser 1, we see a condensate outflow or feed tube 12 having a condensate flow 13. In the lower left of FIG. 1A are seen an ink-base tank 3 containing a quantity of ink-concentrate 16, for example. Adjacent that is mixing tank 4 containing mixed ink-base 16 and water condensate 28, the mixture or solution labeled therein as liquid 17. A feedtube 14 with a flow 15 of ink-base is shown feeding ink-base to the mixing tank 4. The mixed ink-base and water 17 is shown flowing through conduit 27 as flow 18.

Microfluidic printhead 19 of FIG. 1A is depicted as being a typical piezo-driven drop-on-demand inkjet head known to the art. In particular, the printhead has the known components including a body 20, an ink chamber 23 within the body, and a piezoceramic transducer 22 coupled to the chamber 23 across flexible chamber-wall 21. An ejection or emission orifice is shown as item 24 and emitted ink droplets 25 are shown being ejected downwards. Those familiar with piezo-jet printing understand that the transducer 22 is pulsed or fired (distorted) in order to eject droplets 25. We again stress that the printhead 19 may be an inkjet printhead for marking paper or may, for example, be a biofluidic printhead for patterning or writing bioarrays or other combinatorial arrays.

The apparatus of FIG. 1A has the following inventive purposes.

A first application is that wherein the "ink-base" 16 is actually a solid, semisolid or liquid ink concentrate. The pure condensed water 28 is mixed with ink-base 16 to form a contrast graphical ink 17 useful for marking a paper or printing documents. Thus, ink-base 16 might, for example, be a dye or pigment that serves to colorize condensed water 28. Those familiar with ink formulation will realize that inks contain many additives for many purposes, and that the concentrate 16 could likewise contain any such additives as well. Advantages of this approach are several. One is that by using water condensate one does not need to store such large volumes of ready-to-print ink. A second is that since we are mixing printable ink onboard, we can mix any desired shade, hue or color. A third is that water evaporation from the ink only remains an issue where mixed printable ink is located, so water evaporation from the ink cartridge is not an issue. A fourth is that we have the option of providing solid ink concentrate in compact sizes with extremely long shelf-life. The condensed water 28 would mix with the concentrate by flowing around it or through it (if it were porous for example) or by having the solid concentrate mixed or dissolved into the condensate. In the case of liquid concentrate ink-base 16, FIG. 1A is properly arranged. In the case of a solid-concentrate ink-base 16, FIG. 1A would be altered slightly so that the condensed water 28 is flowed through or by the solid concentrate before the mixture or solution is passed into the printhead as flow 18. It should also be obvious that if one takes the approach of having the customer purchase and install solid-like ink "cartridges" or charges, that such solid articles would be insertable into the appropriate tanks (such as item 3) easily and without dealing with messy ink or precise mating form and function. The solid ink could literally be dropped into the tank based on a sensor telling the user that a new one is required. Within the scope of the present invention is the jetting of the condensed water itself wherein it is not mixed with anything in the printhead. This could be used, for example, for implementing a reactive ink strategy wherein the ink has two parts that react with each other. One part is jetted water and the other part is either already on the paper or is jetted separately. The proportion of condensed water mixed with the user-provided marking constituent may be varied, for example, to vary color, hue, saturation, opacity, drop size, drop viscosity, wettability, porosity or spot size. Any means of mixing, entraining or dissolving the concentrate 16 into the water 28 may be employed that is practical, including but not limited to: a) room temperature dissolution, b) mechanically assisted dissolution, c) ultrasonically enhanced dissolution, d) thermally activated dissolution, or e) chemical reaction. The ratio of concentrate 16 to water 28 may be controllably varied so as to control a useful parameter of the jettable media such as color, hue, saturation, a biological concentration, a pH, an electrical conductivity etc.

Those familiar with condensation and heat transfer will realize that any cooled surface or material maintained below the local dew point temperature (of the targeted condensate species) can be condensed upon or within. It will also be realized that one does not want to uncontrollably condense so much water that the device is flooded or such that an excessive amount of power is consumed. Along these lines, the present inventors anticipate the use of feedback such that a controlled amount of water (or other targeted condensate(s)) is condensed. We also anticipate that the condensation reservoir or region will be as thermally insulated from the ambient as possible such that the cooling component 8 is working solely to cool air inside the condenser and not to cool the condensers surroundings resulting is water on the desktop. It should be realized that the volumetric usage-rate of ink-jettable materials is often extremely small so that the physical volume of water needing condensation is very small, on the order of 0.01 to 1.0 cubic centimeters per hour in many applications. It should also be realized that the condensed water is very pure and will therefore not foul the fluidic channels and orifices.

This does not, however, preclude filtering of the condensate. Readers will also be aware that the amount of water extractable from the ambient is a function of the ambient humidity. Included in the scope is the use of appropriate sensors and control algorithms to make the condensation means work only as hard as it needs to not interrupt a printing or patterning process utilizing or consuming the condensate(s). We also include in the scope the control of the ambient of the condensed water, either to retain it or to make it easily interfaced to the microfluidic device such as 19 or 4.

We wish to emphasize that we have shown a physically separate condenser and printhead as well as a condenser that has a closed reservoir. In fact, the condenser and printhead could alternatively be physically cointegrated if desired. Furthermore, the condenser could be an open surface, a semi-closed or protected surface or an interior or exterior surface of a permeable or porous material or film. A high-area set of fins or fingers, or even a cooled porous material into which condensation takes place aided by wicking action may be employed. The rate of condensation and the amount of condensate held in reserve, if any, can be tied to the immediate and/or anticipated printing or patterning rates using known feedback strategies, algorithms and sensors. The condenser design is largely a matter of energy efficiency and size.

Readers familiar with recent patent literature in the ink-jet field will be aware of several schemes wherein ink colors or hues are mixed in the printhead in tiny mixing chambers. A separate fluid or fluid-charge is then frequently used to flush-out or clean such chambers before the next color is mixed therein. Within the scope of this invention is the integration of such mixing in our microfluidic device or printhead 19 in this example. Such mixing could involve combining water 28 and the ink-base 16. The cleaning aspect will be discussed later under a separate embodiment.

We teach thermal condensation components such as thermojunction-devices and expansion nozzles. We specifically include in the scope any type of condenser operating on any principle. The requirement for the condenser is only that it directly or indirectly extract water (or other desired condensate) from an ambient, most typically an atmospheric ambient. It may store it or use it directly, or both. Auxiliary holding and mixing reservoirs or tanks may or may not be employed. By ambient we most preferably mean from the surrounding air having a humidity and a dew point. However, we go so far as to include condensation being part of a distillation process wherein tap water to be distilled by the unit is provided. In that extreme case, the device incorporates a distiller (not shown) that has a condenser. Also in the scope of the invention is condensation, solidification or freezing of condensates from other gaseous, vaporous or even solid-like materials such as from gel-like materials or biological matter.

In addition to the obvious inkjet graphics printers and bioarray printers made possible by the invention, we also mention that among the scope of any fluidic patterning applications is also the making of flat-panel and thin-film displays. Xerox, among others, has demonstrated ink-jet made flat panel displays. The printhead 19 (or even the condenser 1 or portion thereof) may or may not be disposable.

The condenser 1 may alternatively be co-integrated into or onto the printhead 19, at least in part (not shown).

Figure 1B:
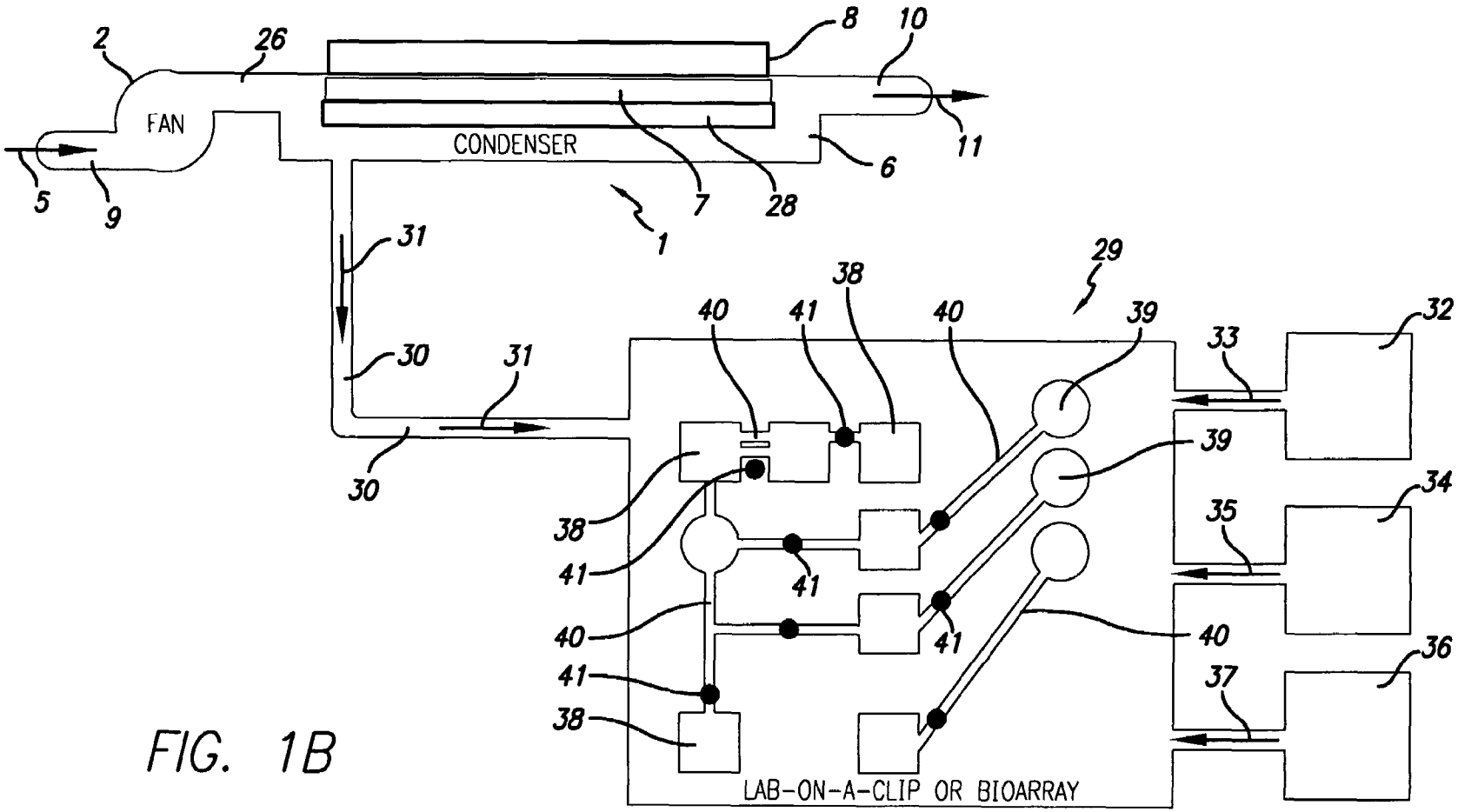

Moving now to FIG. 1B, we see that the familiar water condenser 1 is now instead coupled to a lab-on-a-chip 29. What we mean by lab-on-a-chip is a microfluidic device which has at least one surface or interior feature utilized to store or route a working fluid or working flowable material such as cellular matter in saline. This is not necessarily simply a substrate on whose surface microfluidic patterning is done as in the biological variation of FIG. 1A. The lab-on-a-chip flowable fluid may be a gas and the flow may comprise diffusion as in column-separation techniques for example.

Specifically in FIG. 1B, we see a lab-on-a-chip ("labchip" hereafter) 29 that is constructed, as commonly done, with a variety of internal features for storing, routing or controlling the flow of at least one flowable material. Fine conduits or lumens 40 are seen as are microvalves 41, storage chambers 39 and processing or mixing chambers 38. To the right of the labchip 29 are three optional reservoirs or sources of working material to be consumed or analyzed by the labchip 29. The three reservoirs 32, 34 and 36 are shown being able to flow their contents to the labchip 29 (or vice-versa) in the form of flows 33,35 and 37 respectively.

Labchip 29, in its operation, may utilize both the material(s) provided in reservoirs 32, 34 and 36 as well as condensed pure water 28 flowing along lumen 30 as flow 31. So the point here is that we have a labchip process with a source of pure water from condenser 1. As a specific example, the reservoirs 32, 34, 36 could contain biological specimens such as blood or urine or DNA or protein-bearing materials for processing or analysis in the labchip 29. The condensed water would be used, for example to form solutions of the materials 32, 34 or 36 on-board the labchip 29. Reservoirs 32, 34 or 36 may also or instead contain saline, buffer solutions, fluorescent biomarkers, targeted molecules or genetic factors as are used in such labchips. One or more additional chambers may be provided (not shown) for media cultivation or genetic amplification, or alternatively, these steps may also be done in the labchip. Also not depicted are the many other types of known features found in labchips, such as pumping means, electrical biasing means, injection or extraction ports, heaters, distribution manifolds, particle sensors, pressure controllers, temperature controllers, flow sensors, optical sensors, mixers, and the like.

In a manner similar to that for FIG. 1A we emphasize that condenser 1 could instead be integrated directly in or on the lab-on-a-chip. (labchip) 29. Also likewise, for the FIG. 1B apparatus and labchip, the user may be able to utilize either more concentrated working materials or dry working materials in reservoirs 32, 34 and 36 if again the condensed water 28 gets mixed with such concentrated or "dry" (including gel-like semisolid, for example) constituents. We also note that reservoirs 32, 34 and 36 may be cointegrated upon or within the labchip instead of being, as shown, separate and connected by external lumens having flows 33, 35 and 37. We expect that in many applications, the condensed water will allow for labchip wet chemistry or wet-processing to be done without the requirement to have a user-provided source of clean or pure water.

Typically, the labchip portion 29 will be disposable but we include in the scope of the invention the case wherein the labchip is not disposable and therefore is a nondisposable instrument or portion thereof.

Figure 2:
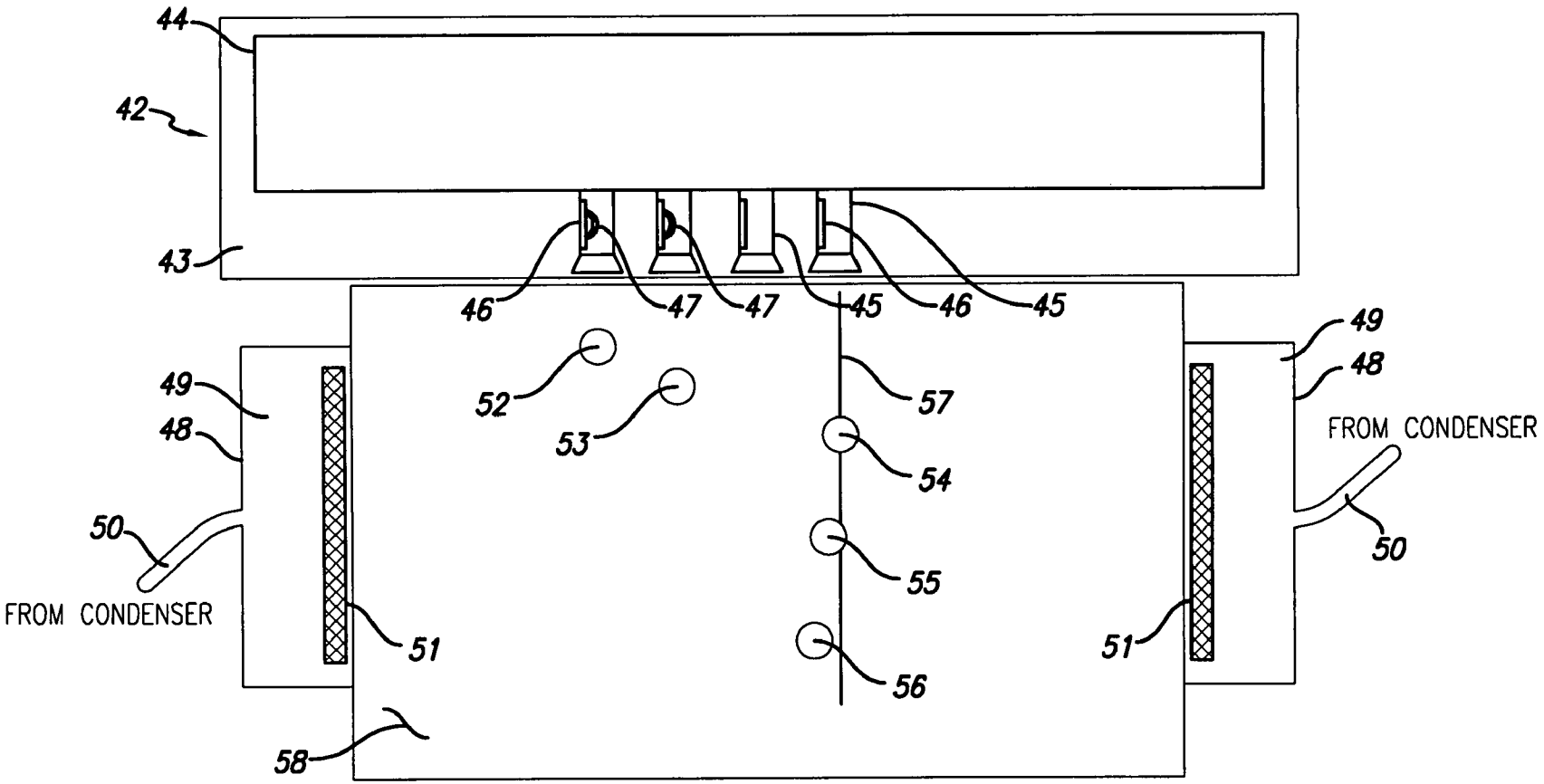
FIG. 2 schematically depicts an embodiment wherein condensed water is used to control humidity in the presence of an otherwise evaporating working fluid.

The next major embodiment is depicted in FIG. 2. Essentially, condensed water is employed in the vapor form to maintain a desired humidity such that droplets, a meniscus, or a quantity of working fluid that would otherwise evaporate can be prevented from evaporating uncontrollably. Not that one may condense to liquid or solid form and then controllably revaporize or atomize the condensate or may "condense" only to the vaporous or microdroplet form as opposed to liquid form.

The depicted example is that of an inkjet printhead wherein tiny ink droplets, perhaps a few picoliters in volume, are in-flight on their way to a paper substrate. Extremely small droplets can have very high evaporation rates partly due to their high surface tension. By shooting the droplets through a moist or humid ambient, one can prevent and/or negate such uncontrolled evaporation. The uncontrolled evaporation can result in variations in the on-paper dot size as well as the degree of spot wet-out or permeation.

Specifically now, looking at FIG. 2, we see a thermal bubblejet-type inkjet printhead 42. The printhead has a body 43 and an ink reservoir 44. Four ejection orifices are depicted as items 45. Each such orifice 45, in the known manner, has associated with it a thermal resistor 46. In the known manner, resistors 46 can be electrically pulsed to cause microbubbles 47 to form. Microbubbles 47 cause ejection of ink droplets, such as droplets 52 and 53, in the familiar manner.

What is new in FIG. 2 are the humidity-producing or water-vapor producing sources 48 placed on each side of the droplet flightpath region. The purpose of these humidity sources 48 is to increase the humidity (gaseous, vaporous or fog-like concentration of the targeted condensate), as necessary, in the flightpath or orifice regions generally shown as region 58. Each humidifier 48 has a body 49, an emission grill or surface 51, and a source of condensed water entering from lumens 50. The condensed water may most conveniently be extracted from the ambient as described earlier.

The humidifiers 48 may comprise any entity that utilizes water extraction from the ambient to cause the humidity in region 58 to be locally increased to a desired level. The simplest form would be thermal or forced-gas evaporators 48 utilizing condensed water extracted in the manner taught earlier. Note that humidity-enhanced region 58 may also or instead be arranged to include the substrate (not shown) or the freshly printed media thereupon.

We note that orifices 45 also benefit from the increased humidity of region 58 and this will help prevent evaporative dryout of ink in the orifices 45, particularly if the ink is aqueous based. One may incorporate a variety of diffusion shields (not shown) in order to limit the bleed-off of the increased humidity 58 back to the ambient. The main known guideline for designing any orifice-local shields would be not to interfere with paper or substrate movement while at the same time enclosing the controlled-humidity region 58 as much as practical. In this application, the shields amount to humidity shields.

Another application for humidity sources 48 is droplet deflection. Specifically, if the air or gas that has been humidified by the condensate (represented by volume 58) has a sideways velocity component, then the ink or other marking droplets will be deflected sideways. In such an application, it is most likely that the humidified air or gas would be sourced from only one side of the flightpath (as opposed to both sides shown) and one would have either no entity on the opposite side or would have an exhaust on the other side. Droplets 54, 55, and 56 depict the position of such a deflected droplet at three points in time. It will be noticed that the droplet is being deflected to the left by humidified air or gas emanating leftwards from the humid-air emitter 48 on the right hand side. The humidified air may receive its lateral velocity component in any manner, such as by using a blower or using the pressure derived from re-evaporating condensed water. We specifically include in the scope the recirculation of our humidified air.

We emphasize that FIG. 2 depicts a printhead or patterning head such as those used for graphical printing on paper or for printing combinatorial bioarrays. The invention could just as well provide humidification for any portion, internal or external, of a biochip or lab-on-a-chip (labchip) as we have defined them herein. It could also provide humidification for stored materials, condensate-utilizing sensors, or for cultured or growing biological media.

Figure 3:
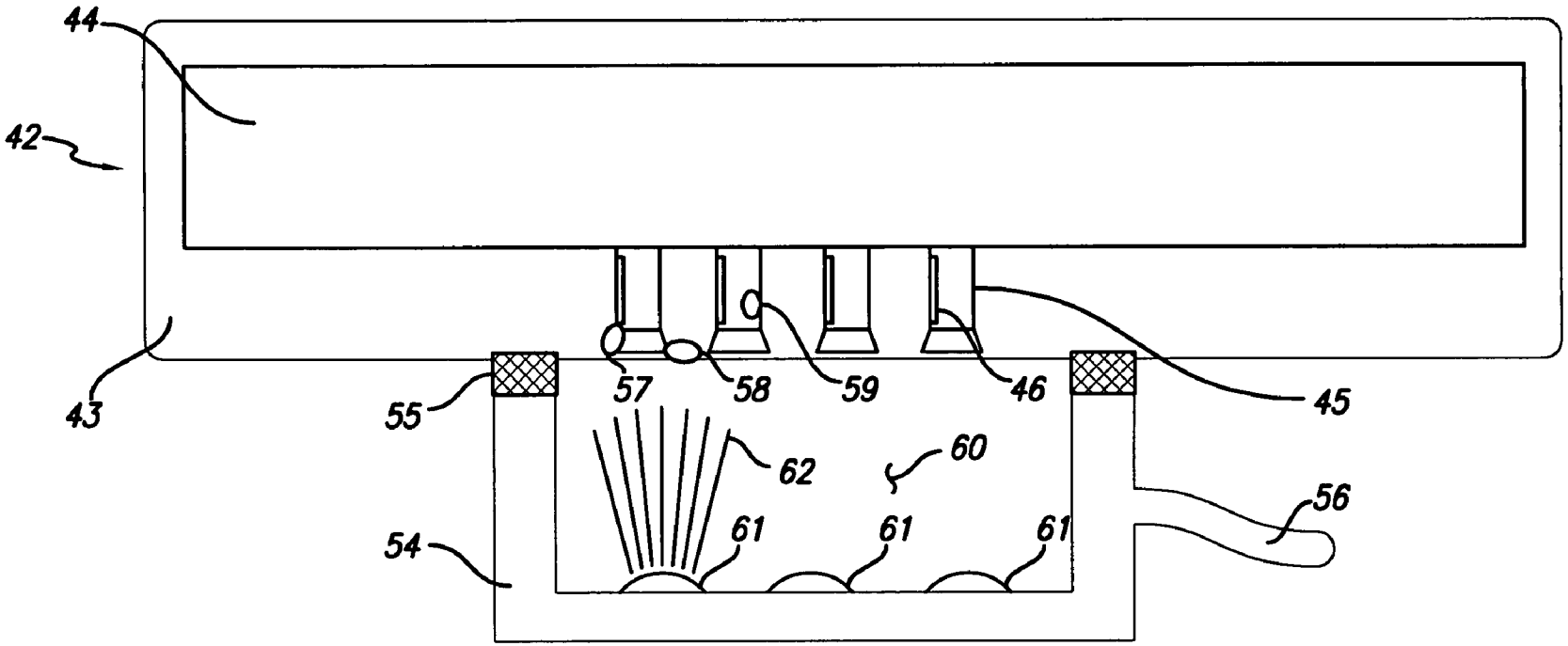
FIG. 3 schematically depicts an embodiment wherein condensed water is used as a cleaning agent in a printhead, patterning head or biochip.

Moving now to FIG. 3, we see an embodiment wherein the condensed water is used to clean or unclog a printhead. Depicted is the inkjet printhead 42 of FIG. 2. We see temporarily coupled to the orifice-face of the printhead 42 a cleaning chamber 54 with an interior volume or ambient 60. The chamber 54 is shown sealed against that surface with a pliable sealing gasket 55. A cleaning agent delivery line is depicted as lumen 56. The cleaning agent comprises, at least in part, condensed water from the inventions condenser means (not shown here). It will be noted that in the interior of chamber 54 are three nozzles and/or drains 61. These, taken together, are capable of delivering fresh cleaning agent and then returning or dumping used cleaning agent. One of the nozzles 61 is shown squirting the cleaning agent toward the orifices 45 and the orifice surface-face. Dried ink, dirt, paper-lint or other undesirable residue is shown fouling the printhead as follows. Residue 57 is situated in the open tapered mouth of an orifice 45. Residue 58 sits on the orifice face. Residue 59 sits inside the narrow diameter of yet another orifice. It is widely known to the inkjet art that such residues can interfere with proper droplet ejection by mechanisms such as unwanted droplet deflections, gross orifice faceplate wetting and outright orifice clogging. It should be obvious that the condensate (e.g. water) could be utilized for cleaning in liquid and/or vapor and/or steam form and could, alternatively, be excited as by ultrasonic agitation.

What is considered novel in this embodiment is not the idea of a gasketed (or not) cleaning chamber but the use of condensed water, vapor or steam as part of a printhead cleaning apparatus of any type. One can easily see that if cleaning is done occasionally, then a condenser system of our invention has plenty of time to gather pure water for such cleanings and store it in a temporary reservoir with minimal storage-related losses. At the time of cleaning, the condensed water is fed through a lumen such as lumen 56 to be sprayed on and into the orifices and orifice surface. It will be appreciated that not a lot of water is required to clean microscopic nozzle arrays.

It will be clear to those familiar with printhead cleaning measures that there are numerous variations of this scheme that are possible. Some of these are as follows. The first is that one or both of the printhead or cleaning chamber may be moved to effect the cleaning, perhaps to a service station(s). The second is that the condensed water may be employed in one of several forms such as a) the sole cleaning liquid, b) a component of a water-based cleaning liquid, c) as hot steam, d) as water or steam working in cooperation with one or more wiper blades or scrapers (not shown), and e) as water or steam working in cooperation with one or more aerosol sprayers, liquid jets or miniature ultrasonic cleaners. Not shown but also an option, is to flow the condensed water, at least as a cleaning or flushing constituent, all the way through orifices and perhaps even through the ink reservoir and connected manifolds and valving.

The condensed water may also be used to prime the printhead, particularly wherein the ink is aqueous-based and the excess water can be conveniently spit into a known spittoon. It could also be used to "park" orifices and/or lumens in a stable wetted state in a standby mode.

Also known to the art are using a housing such as 54 to apply pressure or vacuum to the orifices 45 to force ink or cleaning fluid through them in one direction and/or another. Again, the novel embodiment here is that condensed, vaporous or steamed water can be used in cooperation with any of these processes.

We have not shown, for simplicity, in depicted cleaning housing 54 any internal plumbing between the nozzles/drains 61 and delivery or extraction lumens 56. It will be clear to the reader that cleaning head 54 may only deliver cleaning solution and allow used solution to drip away or evaporate. Alternatively head 54 may also act as a drain. It will also be clear that wiper or scraper blades might be a part of chamber 54 or may be separate or may not be used at all. Chamber 54 may be part of a spittoon or a spittoon may be separately provided. Chamber 54 may be used only for priming, priming and cleaning, or only cleaning.

Figure 4:
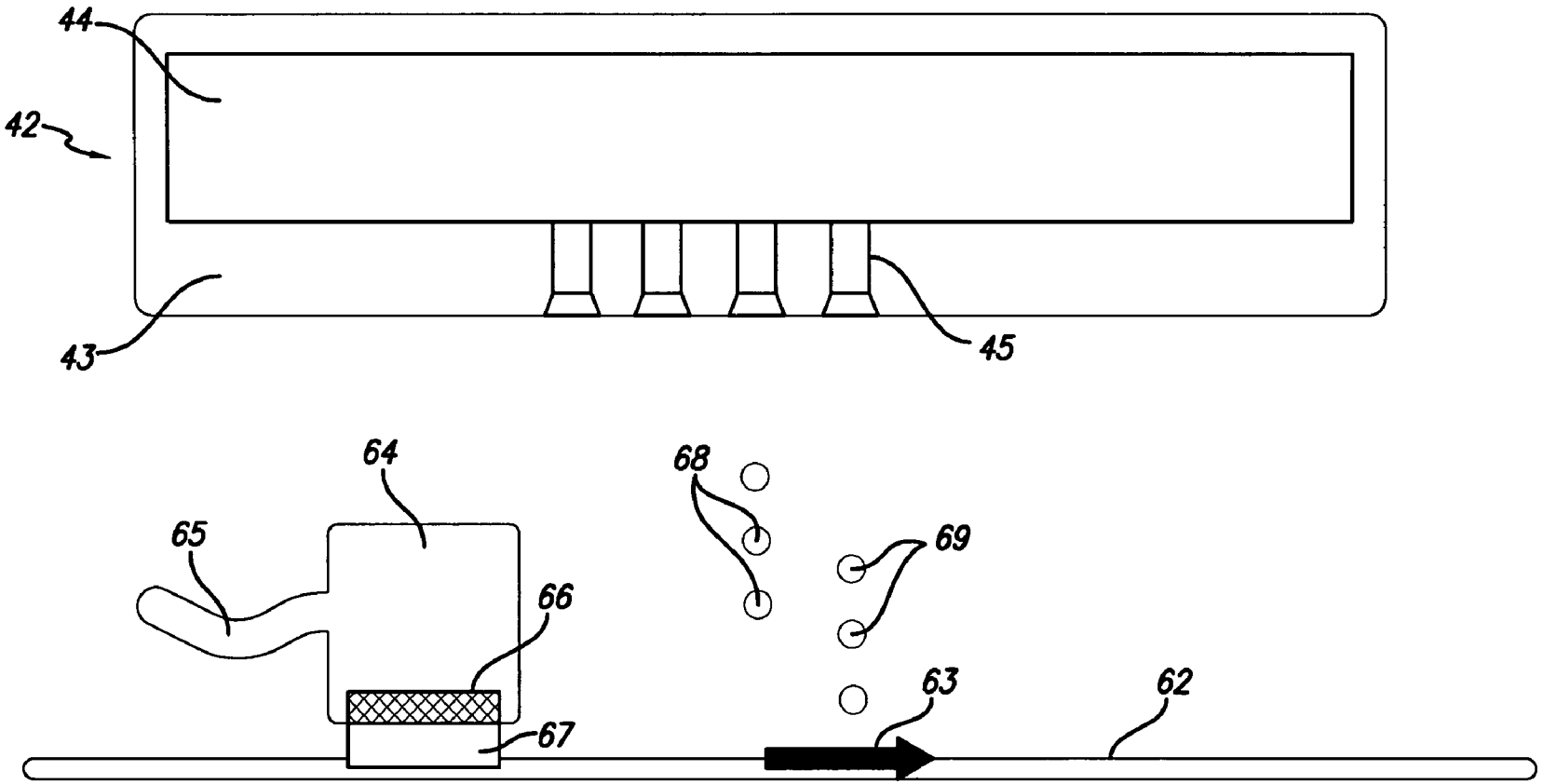
FIG. 4 schematically depicts an embodiment wherein condensed water serves to pre-treat or post-treat a graphical or biological substrate or to treat printed or patterned matter thereon.

The next inventive embodiment is seen in FIG. 4. Therein is depicted familiar inkjet printhead 42. New here is that we show a piece of paper 62 which is being printed upon. It will be noted that as printing occurs the paper 62 is translating to the right per arrow 63. Also shown is a substrate or paper treatment device 64. For example, device 64 might pre-treat the paper 62 with an aqueous medium to enhance printability or image quality. Pretreatment device 64 is shown as having a feed lumen 65 which delivers, at least in part, our condensed water (condenser not shown) in liquid, vapor, fog, mist or steam form through an aperture or port 66. The pretreatment involves component 64 directing downwards, upon, toward or into the paper a stream or cloud or pretreatment medium in the form of cloud 67. Since paper 62 is moving to the right 63, it should be clear that the pretreated regions end up under the downward projected ink droplets 68 and 69 fairly quickly. Thus, the humidity of the substrate can be controlled. Auxiliary drying means known to the art may also be used but are not shown.

The reader will be aware that treatment subunit 64 could be used for a wide variety of processes even just within the realm of inkjet printing on paper. For example, widely known are methods to pre-treat paper to enhance printability and image quality, methods to post-treat paper after printing to seal and protect the printed letters, and even treating to cure or dry reactive inks or aqueous inks. Thus, we include in the scope of the invention any paper or print treatment that utilizes condensed water in any of its states, i.e., liquid, vapor, mist, fog, steam or gas. Note that depending on whether it is a pretreatment or post-treatment, one would do the treatment before or after (or both) the media jetting. The shown example of FIG. 4 depicts a humidification pretreatment known to have effects on ink wet-out, wicking, and penetration, for example. The treatment could just as well, in another embodiment, be a precoating of nourishing gel on or in which to grow or incubate a biologic species.

The reader will also realize that this treatment embodiment can apply not just to ink and paper, but also to any marking material and any markable substrate or surface. Furthermore, we expressly include in the scope of the invention the pretreatment, treatment, or post-treatment of any biological array, biological printed matter, and lab-on-a-chip portion, of lab-on-a-chip working material. The novel aspect here is that treatment is done as part of the operation of a microfluidic device using a condensate such as condensed water. We expressly note that FIG. 4 depicts treatment of a paper 62. The inventive embodiment may also be applied to treatment of confined or enclosed substrates or working materials, such as those inside a labchip or upon a bioarray.

The next embodiment utilizes our condensed water in one or more of its forms (e.g., liquid, gas, mist, fog, vapor, steam) to do useful work or to transfer energy in association with a microfluidic device. Condensed water can do work, for example, by conversion to (or from) steam wherein the steam pressure causes a useful displacement of a medium or a member of a labchip or MEMs apparatus. Liquid water, for example, can serve as a liquid-phase hydraulic fluid such that a separate pressurization means (e.g. a pump) can usefully actuate a remote hydraulic valve or other hydraulically activated labchip or MEMs member. In that application, the water is transferring energy from one member to another in a fairly efficient manner known to hydraulic designers.

Figure 5:
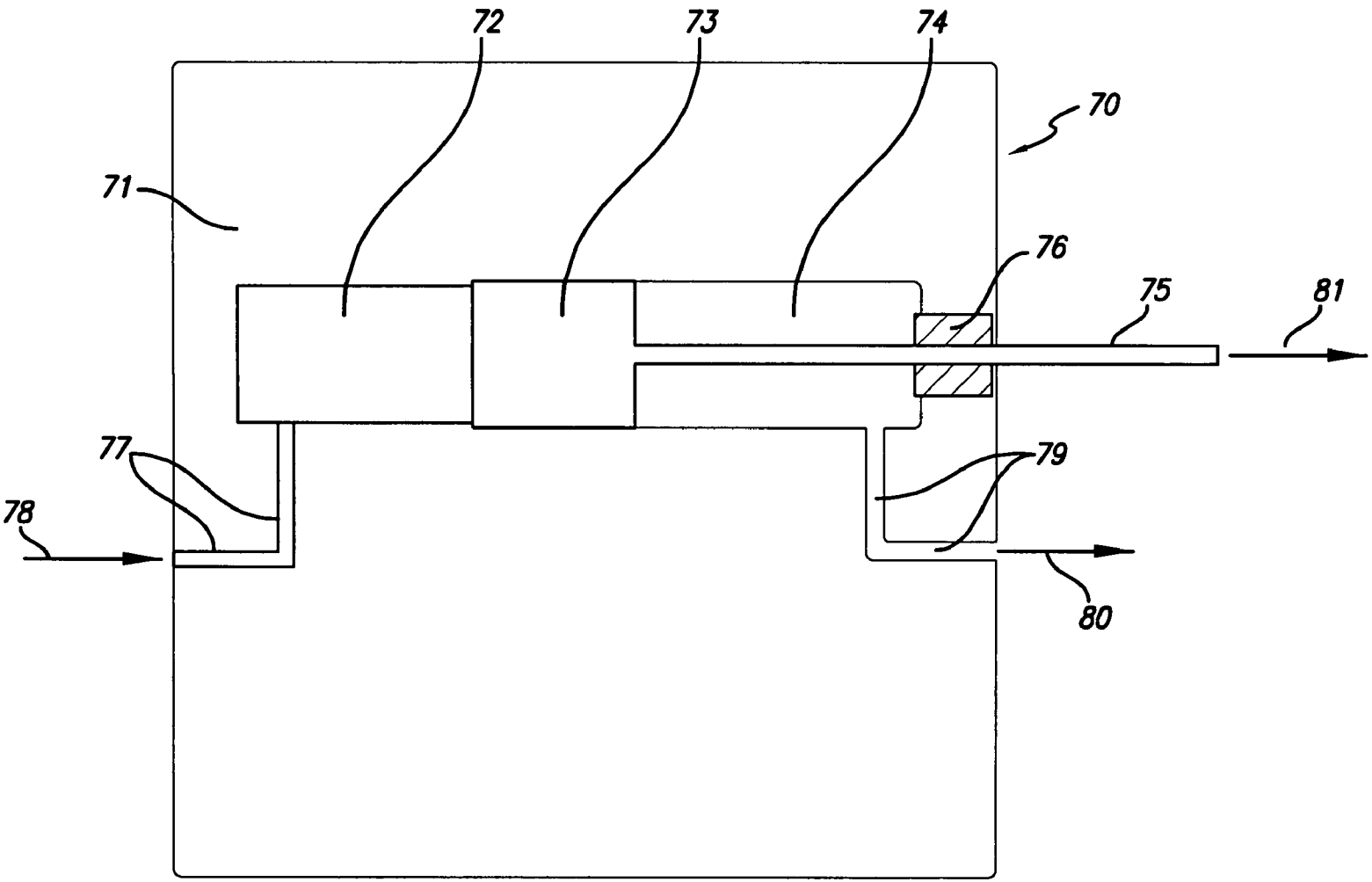
FIG. 5 schematically depicts an embodiment wherein condensed water serves to hydraulically or pneumatically do work or transfer energy in a microfluidic device.

FIG. 5 depicts these features as follows. A microfluidic chip 70 is shown schematically. The body of the chip 71 has a movable piston 73 slideable in a cylinder. The piston 73 has a connecting arm or connecting rod 75. The connecting rod slides through a gasket or seal 76. The cylinder has a portion 72 to the left of the piston 73 and a portion 74 to the right of piston 73. Fluidic or pneumatic lines 77 and 79 are depicted for the purpose of delivering pressurized fluid (steam or gas) to a first side of piston 73 and to allow it to vent from the other side of piston 73. In this manner, the pressurized fluid, steam or gas can move or push the piston 73 back and forth in its cylinder. We have depicted in FIG. 5 water or steam made from our inventive water condensate means (not shown) being delivered as flow 78 into lumens or conduits 77 to pressurize cylinder portion 72. Likewise, we show air from the other side of the piston 73 in cylinder portion 74 being displaced by piston 73 (as it moved rightward) out conduit or lumen 79 as flow 80. One may deliver any form of the condensed water of the invention to ports such as 77 or 79, such as liquid water, steam or water vapor. Numerous means to pressurize these water forms are known to the microfluidic arts. For example, input pressurized flow 78 could be steam or hot water vapor formed at a thermal resistor or heater similar to those used in thermal-jet printers. Likewise, flow 78 could be pressurized liquid water having been pressurized by a MEMs style pressurization diaphragm that is magnetically or electromagnetically driven. It is not our purpose here to describe the many ways of pressurizing liquids or gases or for forming steam or water-vapor from water. Our purpose is simply to demonstrate that the condensed water of the invention can be used in several later forms to drive or actuate mechanisms such as movable piston 73. It should be obvious that, when piston 73 is driven in the manner described, useful work can be done by connecting to connecting rod 75. Those familiar with microfluidic and MEMs devices are aware of the broad host of pumps, valves, impellers, mechanisms, latches, and gear-trains that have been demonstrated. Our point here is that although we have described a pressurization means offboard the microfluidic chip 70, one could just as well incorporate an onboard pressurization means, such as a thermal resistor which either turns condensed water to steam or expands condensed water without a phase-change by heating. Note that with one we have a gaseous driving media at the piston 73 and with the other we have a liquid driving media at piston 73. The present inventors envision complex MEMs chips with at least microfluidic (water, steam, water vapor) driving or actuation means. In many applications, the MEMs chip may already be microfluidic in nature such as a lab-on-a-chip would be. One could have applications wherein hundreds of valves are being open and closed by the pressurization means taught herein. Typically, positive gage pressure will be applied, but the astute engineer will realize that one could create negative gage pressure using condensed water by, for example, allowing steam to condense (or hot water to cool) in an otherwise closed volume. A generic advantage of the pneumatic (steam or water vapor) or hydraulic (water) actuation and driving means here is that the microfluidic device 70 can be largely (if not totally) constructed without the use of electrical driving and switching means. In other words, a piston (or valve) 73 can be pneumatically or hydraulically driven rather than requiring an electrical or electromagnetic actuator which likely has disadvantages of high voltage, space consumption and the possibility of electrical leakage and breakdown. Deflectable membranes or diaphragms may also be driven.

Figure 6B:
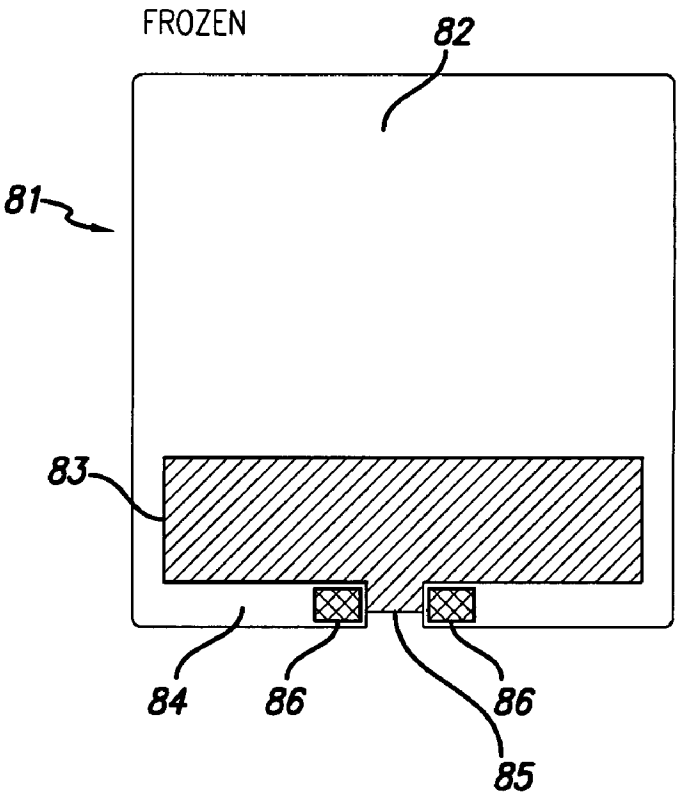
FIGS. 6A and 6B schematically depict an embodiment wherein frozen liquids or frozen flowable materials, condensed or not, allow for extended storage of inks, biochips or reservoirs of associated consumable materials in frozen form.
Figure 6A:
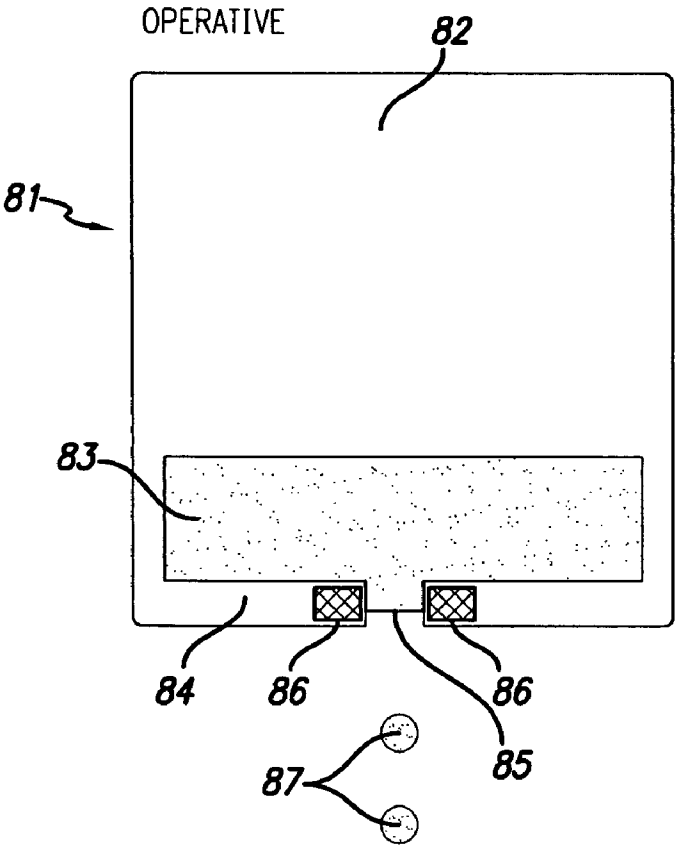

Moving now to the next embodiment in FIGS. 6A-6B, we see an inkjet printhead 81 in an operative condition (FIG. 6A) and a "frozen" condition (FIG. 6B). Before going through the figure's details, let us simply say that the inventive aspect of this embodiment is that we freeze flowable materials in or on microfluidic devices in order to preserve them, prevent them from drying out, prevent them from dewetting, prevent them from ageing or prevent them from growing bubbles or having air diffuse or migrate into them. The example shown has ink frozen such that it does not dry out, dewet or grow bubbles or entrain gas by sitting as a liquid for a long idle period. In this embodiment, we are talking about more than just superficial surface-freezing (next embodiment) but volumetric freezing (this embodiment). By "volumetric" we mean a frozen thickness dimension is on the same order of magnitude as a frozen lateral dimension, i.e., it is not just an overlying thin film with no useful structural thickness. So, for example, the liquid ink contents of an orifice could be frozen, if not entire portions of the adjacent ink manifold and distribution lumens and conduits. In this embodiment, what material is being frozen might be the condensed water (if used) and/or a working flowable material or medium processed or used by the MEMs of microfluidic chip device. So, to be clear, this embodiment does not require the use of condensed water; rather, the frozen flowable material can be a working fluid like an ink in an inkjet printhead.

Specifically referring now to FIG. 6A, starting with the left "operative" inkjet head 81, we see what could be, for example a piezo-inkjet head. The piezocrystal is, for example, on the bottom face of the ink chamber so it is out of view. In any event, inkjet head 81 has a body 82 and an ink-filled distribution manifold or reservoir 83. In the example shown, we depict only one ink orifice having an ink meniscus 85 in it facing the ambient. We show a couple of ejected droplets of ink 87 having been ejected from the single orifice of the operative printhead moments earlier. The single orifice of this simplified example is in a faceplate or orifice plate 84 in the known manner. What is new here is cooling means 86, which is shown in this example surrounding the single orifice. The cooling device 86 could, for example, comprise a thermojunction cooler or semiconductor thermal-junction cooling device as described earlier for water condensation. In the operative printhead of FIG. 6A, cooler 86 is inactive.

Now moving to FIG. 6B and the "frozen" printhead, we have depicted the ink in the manifold/reservoir 83 as well as in the orifice 85 as darkened or frozen solid (or vitrified). In essence, when ink jetting activity stopped (on the left), we turned the cooler 86 on (or to a higher level of cooling) and caused it to extract heat from the region of the orifice and manifold/reservoir. Sufficient heat removal causes freezing of the ink in manifold 83 as well as that comprising meniscus and orifice volume 85.

We note that frozen ink cannot as easily dewet, easily grow bubbles nor dry out as liquid ink can. In fact, by appropriate freezing, the printhead may not even have to be extensively reprimed as is a frequent current practice upon restart, especially after a long ink-jetting shutdown. Instead, upon restart, we may simply thaw the inkpath.

Those familiar with heat-transfer engineering will likely immediately see that in order to freeze a volume of ink, for example, that this can be done most efficiently if the cooler is well thermally-coupled to the ink volume(s) and the volume is thermally insulated from its surroundings other than the cooler. Such an ideal can be approached by judicious and known use of thermal insulators and choice of geometries to minimize ink-volume thermal-coupling to anything other than the cooler. For example, printhead body 82 and faceplate 84 could be chosen to be a ceramic or glass with very low thermal conductivity, for example, alumina.

For example, although we show the entire reservoir/manifold of ink and the meniscus/plug as all being frozen in the "frozen" FIG. 6B, we could have alternatively arranged to freeze only that ink in the orifice itself, a hugely smaller volume. Such more-limited freezing would still essentially prevent any air-ingress, dewetting or dryout of the orifice or of the reservoir/manifold via communication with the atmosphere through an unfrozen orifice 85. Such limited localized freezing could easily be accomplished by having the orifice isolated by a surrounding thermally-insulating cylinder (not shown). At the same time, the thermoelectric cooling junction device 86, being fairly small if desired, could be coupled only or mainly to the thermally isolated orifice 85. Now when the thermoelectric cooler 86 is turned on the thermally isolated orifice 85 full of ink freezes over quickly with little cooling-power needed. Only a low standby cooling power would likely be needed.

It should be apparent to the reader that this inventive embodiment can be applied to any microfluidic device. In a biologically oriented lab-on-a-chip, for example, one could freeze or even quick-freeze the working fluids or specimens in the chip's microscopic or tiny lumens, conduits and reservoirs. Doing this could allow long-term storage of biochips despite their having materials in them which would normally dry out, degrade, thermally-degrade, dewet, grow bubbles or have their contents become nonviable. The fact that the lumens and conduits (or channels) are so small can make it quite easy and quick to perform such preservative freezing. It is widely known in the field of cellular cryopreservation, for example, that quick freezing of cell-sized entities is very effective at avoiding damaging ice-crystals. Many biological materials, reagents and associated processing fluids and gels have improved lifetimes or shelf-life when cooled or frozen.

Any fluid, gel, cream, paste, emulsion, culture or suspension, for example, can be protected in this manner. A bodily fluid or biological material may likewise be preserved. The material or medium does not have to be flowable and does not have to be flowable at the time of freezing. Blood, for example, could be frozen in such a biochip.

We include in the scope of this embodiment the cooler taking any form and being either separate or cointegrated with the microfluidic product, say an inkjet head or a blood analysis biochip. In fact, the cooler can even be an immersion or exposure to a tank or stream of liquid nitrogen, for example.

In our invention and all of its embodiments, we mean by freezing to also include vitrification, which is a noncrystalline glassy state achieved with the highest freezing rates wherein crystalline reordering does not have time to take place. Vitrification is preferred for many biological media because it avoids mechanically destructive ice crystals from forming. Those familiar with freezing practices will appreciate that we also include in "freezing" a technical definition of a state of material being near, at or below its glass-transition temperature or $T_g$ as it is commonly known. This region of temperature is that wherein the glassy state begins to form and then becomes fully formed.

The present inventors see one highly desirable use being the freezing of huge arrays of orifices and fine lumens as this can prevent dewetting, bubble growth, dryout and associated clogging as well as possibly avoid repriming after shutdown. Note especially that if only inkjet orifices are being frozen, for example, the cooling rate can be high and the cooling power consumption very low. What this means is that it becomes practical, for example, to freeze and thaw an inkjet orifice in a matter of seconds or less-repeatedly if desired.

Also specifically included in the scope of the invention are applications wherein the working material being frozen has one of the following attributes:

a) Like blood, it is a biological material with a proven freezing capability.
b) It is a multiphase material otherwise prone to undesired settling, crystallization, precipitation or phase alteration.
c) It is a marking material or working material containing a volatile solvent or constituent whose evaporation or sublimation is to be limited.
d) It is a material that undergoes a thermally enabled phase change during normal use, and it is desired to assure that the change does not occur while waiting for such use.
e) The freezing beneficially mechanically clamps or blocks the motion of movable members of the microfluidic chip. For example, the freezing thereby also locks all onboard microvalves in their desired open or closed states.
f) The freezing preserves a biological viability of biological matter, such as sperm or genetic material.
g) The material is being jetted from a printhead/patterning-head or processed in/on a microfluidic biochip, for example, and it is frozen and only the portion to be jetted or processed is thawed as necessary.
h) The material comprises a viable living or multiplying biological entity, such as bacteria or virus, and the cooler temperature limits or stops the growth rate until a higher growth rate is desired.

The present invention is fundamentally different, for example, than an inkjet printhead which uses solid wax colorant that is melted and jetted. Therein, the solid wax is an ambient stable state and the jettable molten-liquid state requires active heating to keep it in its liquid unstable state. In this embodiment of our invention, the media or material is actively cooled to a preserved or more storage-friendly state.

It will be noted here (and in the next embodiment) that if the volume being frozen or the cooling means itself has any significant thermal communication with the ambient, then atmospheric condensed water will deposit upon the exposed subcooled or frozen surfaces. Again, by judicious use of insulation and thermal isolation, the amount of condensed water and ice that could be a problem can be greatly minimized such that it is so small that any occasional drips from a subcooled or iced surface evaporate without notice, perhaps into a specially designed catchment basin. One may alternatively choose to condense on an exposed surface and have the condensate runoff flow to a reservoir.

Figure 7B:
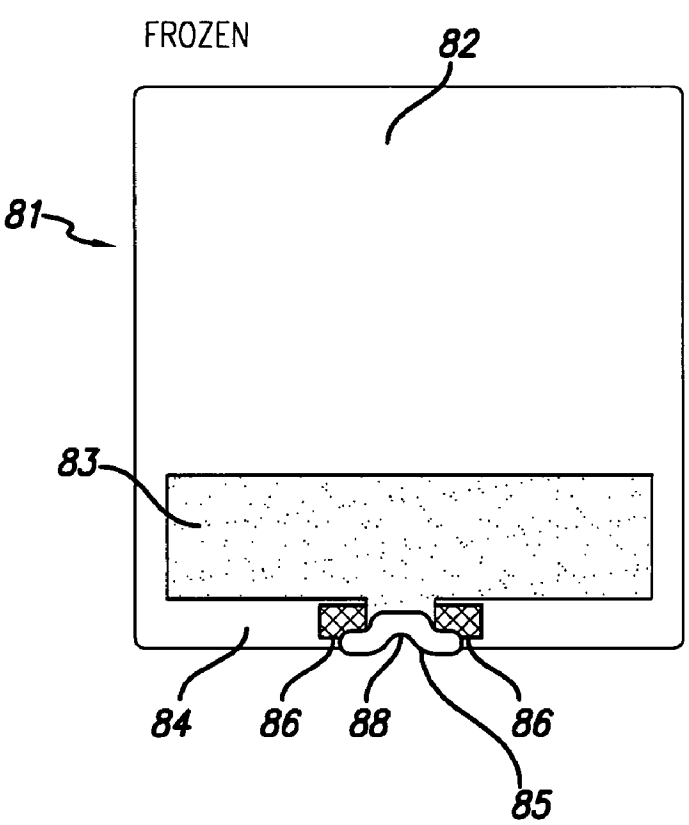
FIGS. 7A and 7B schematically depict an embodiment wherein frozen liquids or frozen flowable materials, condensed or not, offer surface protection, temporary fixation or orifice-plugging or throttling in microfluidic devices.
Figure 7A:
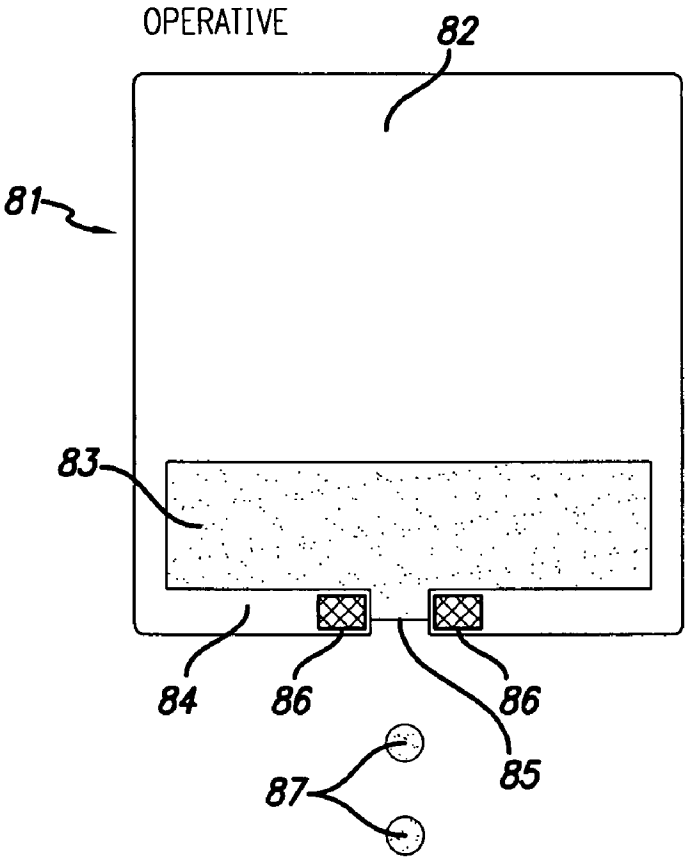

Moving now to the next embodiment of the invention, we again see in FIGS. 7A-7B our familiar example microfluidic device being an inkjet printhead 81 with the same parts as that in FIGS. 6A-6B and a left operative condition (FIG. 7A) and a right frozen condition (FIG. 7B). The main difference here in FIGS. 7A-7B is that we are freezing a surface or surface layer as opposed to a bulk volume. So, typically, the length of the surface-frozen region will be several times or more than its thickness, and may be tens or even hundreds of times as long. We specifically note in FIG. 7B that a film of ice or solidified microfluidic media or medium 88 is depicted. This could be frozen condensed atmospheric water and/or a frozen or vitrified microfluidic working material or medium. Again, solid-state cooler 86 is depicted as delivering the cooling effect, which causes the freezing of film 88. In a typical real application, since the frozen film is at a microfluidic device media/atmosphere interface, it is expected that a combination of some condensed frozen water from the atmosphere and some surface freezing of the chip medium will both be involved. Such a situation might involve, for example, a frozen layer 88 having 50 microns of water ice on top of 50 microns of frozen chip media. The two could also intermix as they freeze. In the event the microfluidic materials freezes below the water freezing temperature, then we could have the situation wherein only frozen water film 88 exists and it may not be not cold enough to freeze the microfluidic media itself.

Such layers or films of frozen material 88 may be on any internal or external surface of the microfluidic device. Such films inside a microfluidic device could comprise frozen media and/or frozen condensed water depending on the application. Not shown but also possible would be a scheme wherein the entire front face of orifice faceplate 84 is frozen over with condensed water or an outpurged microfluidic media flowable or condensable material.

We have previously mentioned and will say again here that the frozen material 88 may provide a clamping or holding function. An example of this could be an inkjet orifice faceplate 84 whereupon undesirable microsatellite ink aerosols (separate from the desired projected droplets) are frozen before they can laterally flow and ball-up into lumps that interfere with jetting.

The volume of such a frozen film is so small that it can be frozen and unfrozen quickly. This allows operation of the microfluidic device or inkjet head in a mode wherein the jetted material flows and is jetted only in its unfrozen condition. The rest of the idle time the orifice 85 could be frozen-over.

It should be apparent that the "thin ice" version of FIG. 7B (as opposed to the "thick ice" version of FIG. 6B) is particularly useful in applications wherein if such freezing is performed, it must be done quickly and/or with minimal transitory and/or standby power (cooling power) consumption.

We include in the scope of the invention variations wherein upon restarting the inkjet head or microfluidic device, one: a) turns the cooler off and thereby encourages melting, b) uses a heating means of any type (not shown) to cause melting, probably in combination with turning the cooler off, and/or c) fires the inkjet orifice to forcefully blow out or fracture the ice film or membrane wherever it is situated.

We also anticipate that some microfluidic devices can be operated beneficially with a frozen film present. As an example, one could grow a frozen ice film in an orifice in order to control the size (e.g., a diameter) of the orifice, the ejecting jetted material being jetted out of an internally ice-coated orifice. It should be obvious that such an orifice diameter can be controlled to have any size or can even be frozen totally shut. If necessary for such a scheme, one could heat the ink to prevent total orifice through-freezing and blockage. Obviously, by varying the orifice size, one can rapidly change the drop size emanating from that given orifice even for a fixed emission pulse (piezo or thermal-bubble pulse, for example).

Figure 8B:
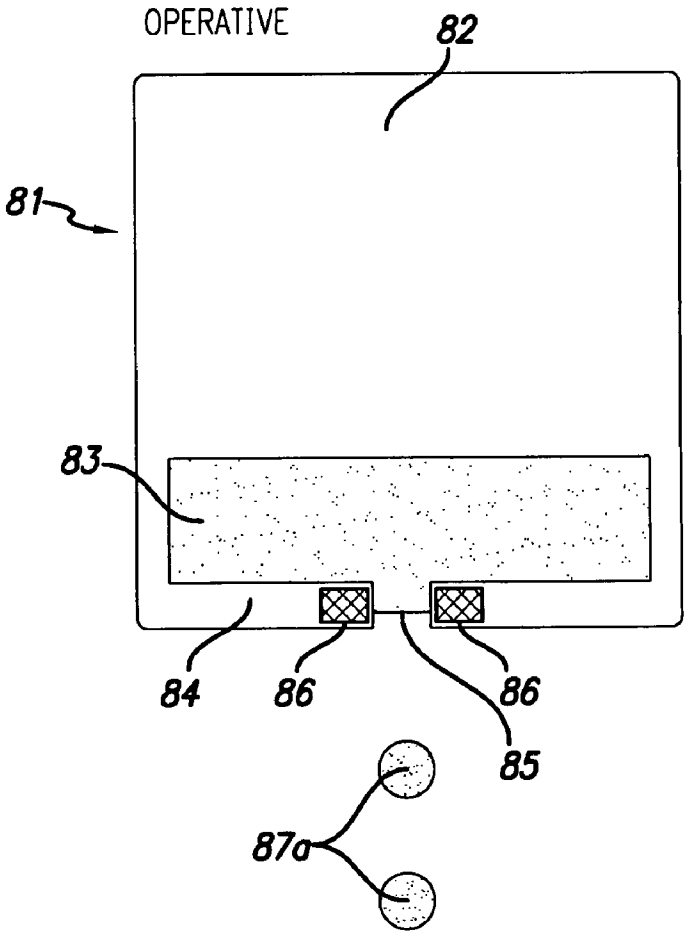
FIGS. 8A and 8B schematically depict an embodiment wherein localized cooling in a microfluidic device maintains a material property or viability in a beneficial state.
Figure 8A:
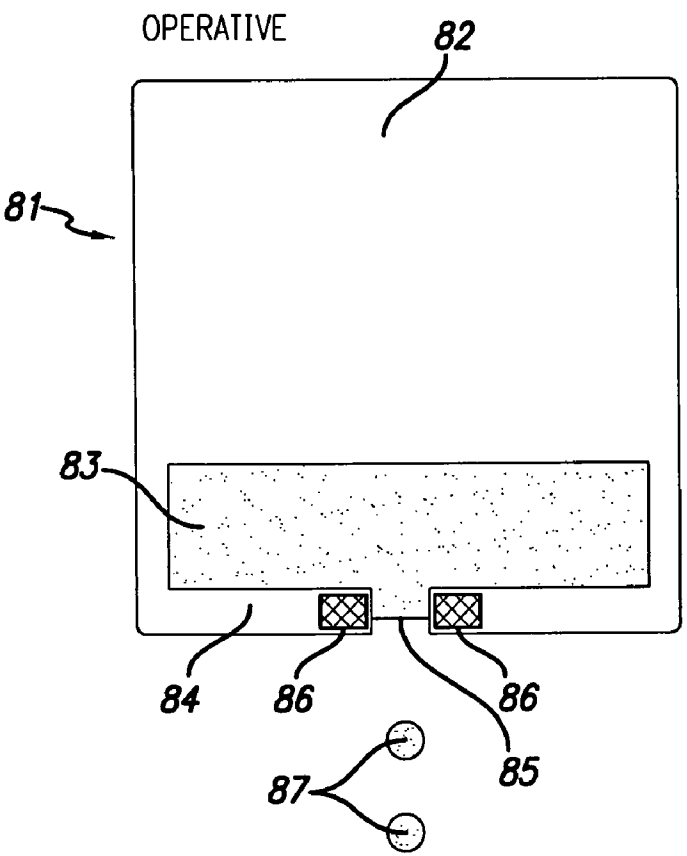

Moving now to the next embodiment seen in FIGS. 8A-8B, we depict again familiar inkjet printhead 81 in two conditions. However, this time, both conditions are operative conditions. It will be noticed that the ink droplets 87 emanating from the left printhead are significantly smaller than the ink droplets 87*a* emanating from the right printhead. We have used cooler 86 such that the ink temperatures in the orifice of the left (FIG. 8A) and right (FIG. 8B) printheads are different. Because the ink temperatures are different, the ink surface-tension and viscosity are different, both of which can affect the droplet size emitted with a given emission pulse in a known manner for a given ink or emitted material or fluid. As an example, the left printhead orifice is cooled 30 degrees Fahrenheit below that of the right printhead orifice. Because the example ink herein gets more viscous and has higher surface tension when it cooler, the cooler left printhead orifice emits smaller or different-sized droplets than its warmer right counterpart.

Included in the scope of this embodiment is purposeful temperature change for the purpose of changing, at least temporarily, any temperature-dependent property or behavior. In all our embodiments, we are cooling relative to what at least one ambient temperature is. Typically, by ambient, we mean room temperature but ambient, within our teaching, may also mean, for example, the temperature of a printhead away from a cooled printhead orifice. The distinction is important because the "ambient" temperature could be that of a warm printer whose orifice is to be cooled and frozen.

Another example of a temperature dependent property would be the ability of the working fluid or media to change its ability to dissolve or entrain a gas or solute. Another would be to reduce its vapor pressure to avoid some amount of undesired evaporation of at least one constituent. Another would be to control a diffusion, chemical-reaction rate or biological growth rate happening in or on the microfluidic device or in a flying droplet emanating there from. For example, a labchip or biochip might implement temperature-controlled electrophoresis or other diffusion-related analytical processing.

Figure 9:
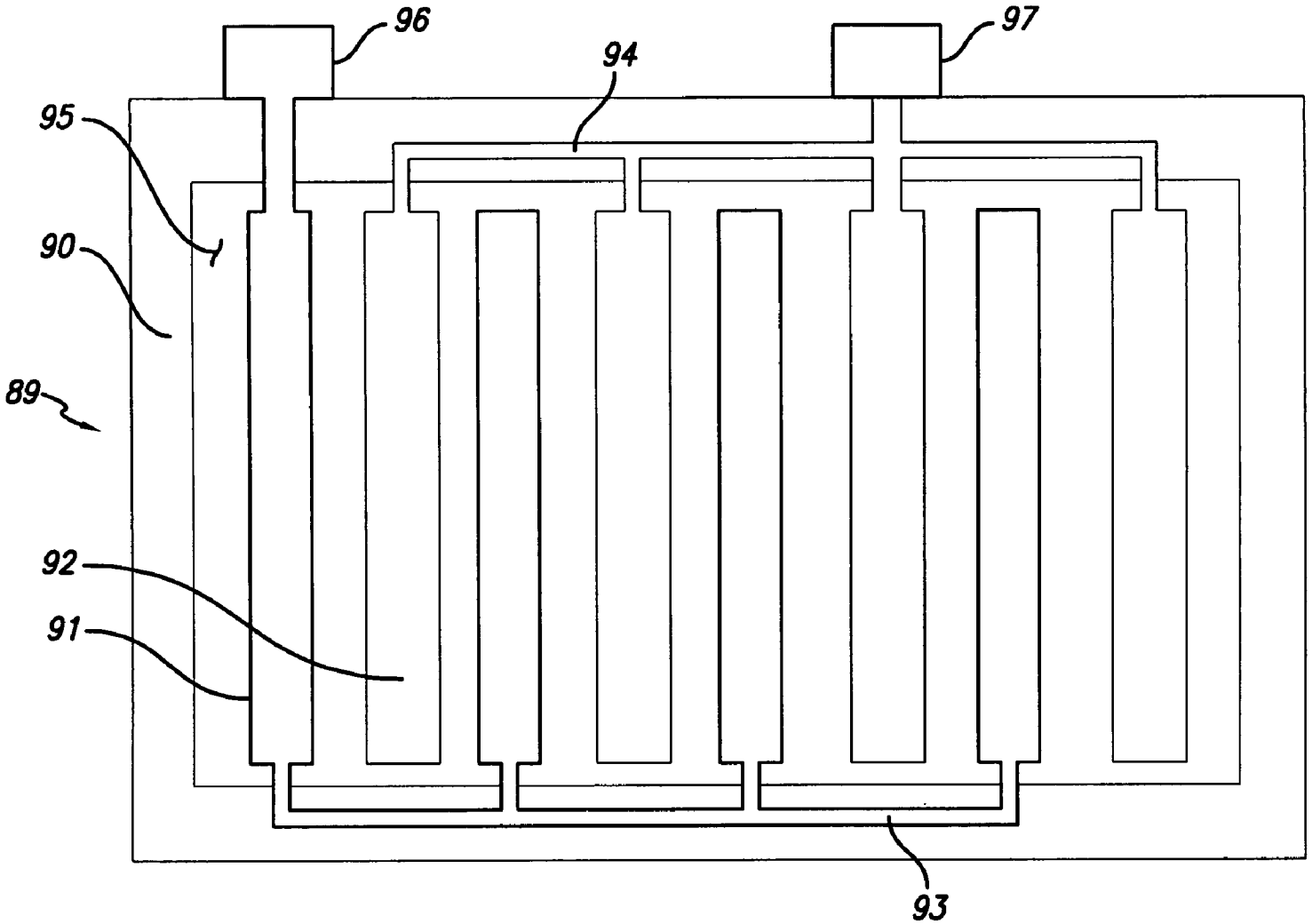
FIG. 9 schematically depicts an embodiment wherein condensed water serves as a working fluid component of a microfluidic battery or fuel-cell.

Moving now to the last embodiment of the present invention, we see in FIG. 9 an electrolyte-based battery. Battery 89 has an outer casement 90 and a set of spaced plates surrounded by electrolyte inside. There are typically two different metals used for the plates 91 and 92, such as lead and lead oxide, Each type of plate is electrically ganged by conductive busbars 93 and 94. External terminals 96 and 97 allow connection to an object requiring the battery's power or to a charger (not shown). An electrolyte 95, such as a liquid acid solution or a solid, surrounds all of the plates. Some electrolytes contain water at some point in their charging or discharging cycles, either as a starting constituent or as a by-product of the electrochemical reaction. In any event, the point of this figure is that power sources exist that utilize liquid water in some form. The inventive aspect here is that we provide water to the battery or power source via our water condensation mechanism (not shown). This could be used, for example, to replace lost water (as in a laptop battery) or to liquefy an electrolyte that is initially in a nonliquid form such as a solid that gets dissolved by water. The power source may alternatively be a fuel cell and may produce oxygen for beneficial use as is known for spacecraft or the most recently developed fuel cells. Recent work has demonstrated a trend to miniaturize batteries to tiny or very thin form. As this occurs, batteries (and fuel cells) begin to look more and more like microfluidic devices if they utilize liquids at any stage of operation or recharging.

We have shown several embodiments that involve a water condensation means, and in the early figures, we depicted the condenser as having a fan. The condenser of the invention may be implemented with or without a fan or may utilize natural convection to bring new wet-air to the condenser to be condensed. If only small amounts of water are needed, then it may not even be necessary to forcefully convect air as a humidity gradient will be set up and still allow delivery of water to the condenser surfaces as by diffusion and natural convection. Further, the condenser may cool the air and thereby cause it to sink (flow) due to buoyancy reasons. In many cases, natural convection caused by any heat generated by the product using the microfluidic device will stir the air quite well to provide a constant fresh source of humid air.

In closing, we again wish to stress that what is being cooled or frozen may be atmospheric water and/or may be a working fluid or media of a labchip, biochip, bioarray, emission orifice, MEMs device, sensor, battery or fuel-cell. In the case of condensing water from the ambient, we have a condenser or, alternatively, condensed water delivered by the user from any source. In the case of cooling or freezing ambient water or any fluid or working media of a device such as labchip, biochip, printhead, emission orifice or MEMs device, we have a cooler. The cooler may be integrated in or upon the device or may be connectively plumbed to the device. The user may also present such cooling as by immersion or exposure, at least temporarily to a cold, refrigerated or cryogenic ambient or surroundings.

The condenser, cooler or device (e.g., labchip, biochip, printhead, etc.) may be disposable or not disposable. In the event of any of these being disposable, we expressly include in the scope of the present invention disposable products made using the invention.

As mentioned in several embodiments, a primary advantage of the invention may be to extend the storage and/or operation of a wide variety of microfluidic devices, including some that only become possible using the invention.

What is claimed is:

1. A printing apparatus for printing at least one printable media or materials upon a substrate or surface, the printing apparatus including a microfluidic printhead, wherein the printing apparatus further includes an ink base for containing ink concentrate, a water condenser for providing atmospheric water from ambient air, a mixing chamber for mixing the Ink concentrate and the water to form ready-to-print ink, and a conduit to supply the inkjet printhead with the ready-to-print ink.

2. The printing apparatus of claim 1 wherein the printable media or material is or includes an ink or colorant.

3. The printing apparatus of claim 1 wherein the printable media or material is or includes a biological material or reagent.

4. The printing apparatus of claim 1 wherein the printable media supports a clinical test or material analysis.

5. The printing apparatus of claim 1 wherein the printable media or material includes the condensed water plus at least one dry or concentrated constituent.

6. The printing apparatus of claim 1 wherein the apparatus is any type of inkjet or ink-jetting printer.

7. The printing apparatus of claim 1 wherein the ink concentrate is a solid, semisolid, or liquid ink concentrate.

8. The printing apparatus of claim 1 wherein the atmospheric water condenser includes an inflow conduit for taking in ambient air, an exhaust conduit for exhausting condensate, a condensing chamber connecting the inflow conduit and the exhaust conduit, a cooler or chiller that condenses water out of the ambient air, and a outflow tube for bringing condensed water from the condensing chamber to the mixing chamber.

9. The printing apparatus of claim 1 wherein the microfluidic printhead emits an ink upon a substrate, the ink including a fluid which is employed in a bioarray, a biological analysis or an analysis or test of a bodily specimen.

10. The printing apparatus of claim 1, wherein the condensed water is utilized for at least one of:

cleaning or defouling the printhead;

pretreating a printable substrate using condensed water;

posttreating a printable substrate using condensed water; or controlling a humidity in the region of the printhead or substrate.

* * * * *